United States Patent [19]

Bibbo et al.

[11] 4,311,491

[45] Jan. 19, 1982

[54] ELECTROSTATIC PRECIPITATOR CONTROL FOR HIGH RESISTIVITY PARTICULATE

[75] Inventors: Peter P. Bibbo, High Bridge; Frederick E. Hankins, Flemington, both of N.J.; Richard Jakoplic, Woodston, Kans.

[73] Assignee: Research Cottrell, Inc., Somerville, N.J.

[21] Appl. No.: 179,254

[22] Filed: Aug. 18, 1980

[51] Int. Cl.[3] ..... B03C 3/66

[52] U.S. Cl. ..... 55/2; 55/105; 323/903

[58] Field of Search ..... 55/105, 2; 323/242, 323/243, 246, 903

[56] References Cited

U.S. PATENT DOCUMENTS 2,935,155 5/1960 Foley .
3,507,096 4/1970 Hall et al. .
3,959,715 5/1976 Canning .
4,138,232 2/1979 Winkler et al. .
4,152,124 5/1979 Davis ..... 323/903 X
4,160,202 7/1979 James et al. .

FOREIGN PATENT DOCUMENTS 859784 1/1961 United Kingdom .
1424346 2/1976 United Kingdom .

*Primary Examiner*—William M. Shoop
*Attorney, Agent, or Firm*—Kerkam, Stowell, Kondracki & Clarke

[57] ABSTRACT

A method and apparatus for optimizing the operating efficiency of an electrostatic precipitator based on controlling the average input power of the precipitator electrodes in response to control signals derived by sensing changes in specific instantaneous peak voltages associated with the average electrode voltages. The method is particularly well suited for electrostatic precipitators processing high resistivity fly ash and exhibiting an inflection region in its KVmin electrode voltage characteristic. The apparatus is organized to serve as a stand alone control system, or as an adjunct to existing electrostatic precipitator control systems.

15 Claims, 4 Drawing Figures

ELECTROSTATIC PRECIPITATOR CONTROL FOR HIGH RESISTIVITY PARTICULATE

DESCRIPTION

Field of Invention

The present invention relates generally to the art of electrostatic precipitators, and in particular to automatic control of electrical power applied to precipitators to enhance their operating efficiency.

More specifically, this invention relates to a method of operation of an electrostatic precipitator processing a high resistivity ash wherein a unique region of the volt/amp characteristic of the precipitator is used as a control element to establish and maintain operation in a high efficiency region, and an apparatus for automatically controlling the power applied to the precipitator electrodes to assure operation in the desired high efficiency region.

Background of Prior Art

Electrostatic precipitators are widely known in the gas cleaning art and are extensively used in a variety of industrial processes to remove particulate matter from gases. Over the years a good deal of effort has been directed to the control aspects of electrostatic precipitators, and the steady incorporation of automatic features into the systems, as well as the more recent incorporation of solid state technology into the control circuitry has brought about substantial advances in the art. For example, U.S. Pat. No. 3,507,096 to Hall et al, assigned to the same assignee as the instant invention, discloses an improved method and apparatus for automatic control of electrostatic precipitators. The apparatus disclosed is comprised largely of solid state components, and a number of precipitator parameters are monitored and used in conjunction with operator set parameters to provide a stable and wide dynamic range control system. The U.S. Pat. No. 3,507,096 effort, however, is primarily directed to maintaining a desired level of precipitator operation to compensate for a number of unwanted system variables. Also U.S. Pat. No. 3,959,715 to Canning discloses an automatic controller for an electrostatic precipitator having an automatic voltage controller based on a "hill-climbing" technique wherein the potentials within the precipitator are monitored to provide digitally processed control signals. British Patent Specification No. 859,784, (published in 1961) discloses a control system directed to improving the operating efficiency of a precipitator based on the sensing of, and acting upon average electrode voltages within the precipitator.

While these and other precipitator control systems appear to be performing adequately with respect to their targeted requirements, these requirements do not appear to have reflected sufficient attention to the problems of automatically controlling and improving the operating efficiency of precipitators processing high resistivity particulates which result from firing certain types of coals. The present invention is directed precisely to these needs, which are clearly not being addressed by existing prior art devices.

BRIEF SUMMARY OF INVENTION

The present invention teaches a method for controlling the excitation of electrostatic precipitators based on sensing the peak values of a particular instantaneous electrode voltage, and generating control signals to control the average input power applied to the precipitator. Specifically, the present method derives the control signals by sensing and comparing successive values of a KVmin voltage characteristic taken at timed intervals, and is especially useful for optimizing the power operating efficiency of an electrostatic precipitator exhibiting a fold-back region in this KVmin voltage characteristic due to processing of high resistivity particulate. An illustrative embodiment of a control system incorporating the method is presented, and includes circuitry for automatically and unambiguously obtaining the desired KVmin samples as the localized maxima (peaks) of a region characterized as being a localized minima in a modified version of the KVmin characteristic curve.

It is therefore a primary object of this invention to provide improved methods and apparatus for exercising control of electrostatic precipitators.

Another object of the present invention is to provide a method for controlling the operation of an electrostatic precipitator based in part on using parameters within the precipitator as reflected in instantaneous peak voltage values, to control the average input power applied to the precipitator.

A further object of the present invention is to provide a method for maximizing the power efficiency of electrostatic precipitators based on using successive samples of the instantaneous KVmin characteristics.

Another object of the present invention is to provide a control system for optimizing the power efficiency of an electrostatic precipitator wherein periodic samples of the desired KVmin characteristics are sampled and held for comparison to derive a control signal from the differences therebetween.

Another object of the present invention is to provide for a fixed selectable offset signal added to or subtracted from one of the two samples that are taken periodically of the KVmin curve, this offset signal, called the delta adjust signal allows operation of the electrostatic precipitator in a predetermined portion of the fold-back region of the KVmin characteristic curves.

It is still another object of this invention to provide a control technique for varying the time internal between a pair of successive samples so that the rate at which samples are taken is compatible with the rate of voltage increase for which the basic transformer controller is adjusted.

BRIEF DESCRIPTION OF DRAWINGS

Additional objects and advantages of the invention will become apparent to those skilled in the art as the description proceeds with reference to the accompanying drawings wherein.

DETAILED DESCRIPTION OF THE INVENTION

Figure 1:
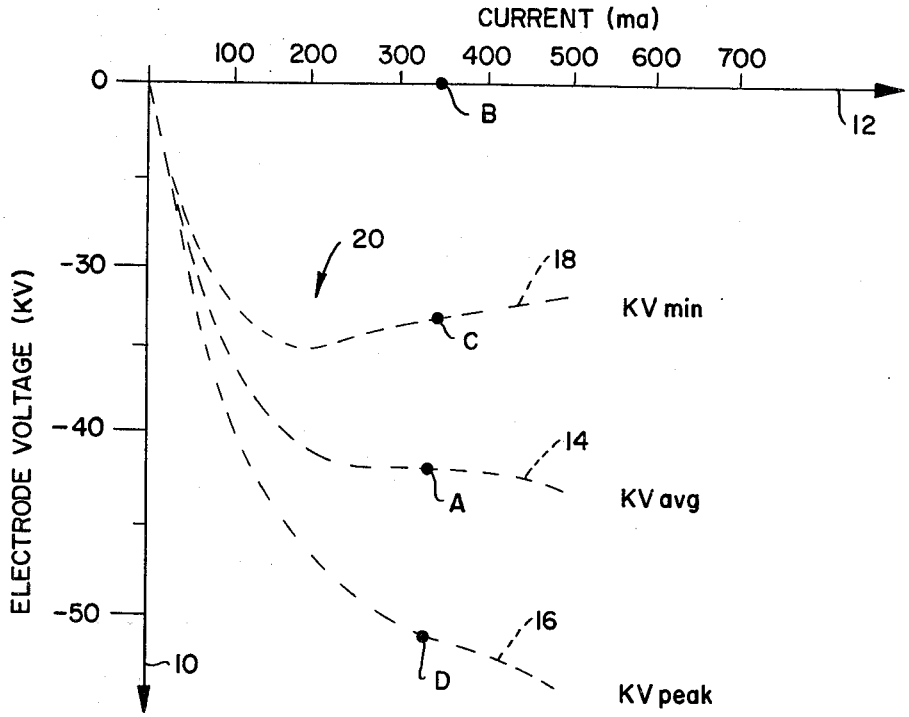
FIG. 1 is a set of voltage/current curves showing the locus of the instantaneous values of electrode excitation voltage vs load current for three key parameters of the excitation waveform.

Referring now to FIG. 1 there is shown a set of voltage/current curves which show the dynamic operation of a controlled electrostatic precipitator for a range of controlled variable parameters. The set of curves apply to a particular set of operating conditions and contain the key elements of the control technique of the present invention.

As is well known in the electrostatic precipitator excitation art, collector efficiency may be optimized by operating the precipitator at power levels determined in large part by the particular type of tasks being performed. In a coal firing application, the type of task would highly be dependent on the resistivity of the ash produced. Also, as is well known in the electrostatic excitation art, it is desirable to establish the electrode operating potentials such that the precipitator functions well into the region where corona discharge constitutes the primary power dissipating action, and just below the region where arc discharge becomes a significant part of this dissipating action. Given this knowledge, it is possible to more precisely optimize an operating point for a precipitator working with a specific type of task by using appropriately selected portions of the resulting waveforms as key elements of the control technique.

A vertical axis of 10 of FIG. 1 represents electrode voltages in kilovolts (KV), and is shown with increasing values of voltage downward to illustrate that the electrode voltage is negative with respect to precipitator ground. A horizontal axis 12 represents average precipitator direct current in milliamperes (ma). As will be made clear, the vertical axis depicts the instantaneous values of voltage for a particular value of current. A first curve 14 shows average electrode voltage (KVavg) versus precipitator current for a range of electrode voltages. A second curve 16 shows peak electrode voltages (KVpeak) vs. precipitator current, and a third curve 18 shows minimum electrode voltage (KVmin) for the same range of operating parameters and conditions. A key factor of the present invention is embodied in the shape of the KVmin curve 18 as compared with both the KVavg curve 14 and the KVpeak curve 16. While the KVpeak curve 16 is continuously increasing (in a negative direction), the KVmin curve contains a fold-back portion or region giving rise to a single localized maximum (mathematically a minimum) in its shape. This is shown as a region 20 in the vicinity of (illustratively) −34 KV, and approximately 200 ma for the particular operating conditions used to derive the data of FIG. 1. The existence of this region is believed to be due to inverse ionization, i.e., the onset of back corona within the precipitator chamber field, and has been found to correspond to optimum precipitator performance, as determined by numerous empirical tests and observations.

It is useful at this point to further particularize the curves shown beyond their description as being instantaneous values as taken from an oscilloscope display using the conventional waveform position designations. Whereas a fixed D.C. potential applied to a linear load would result in only a single voltage point on the volt/amp curve. Electrostatic precipitators are, however, electrified with unfiltered rectified A.C. which, coupled with the resistance and capacitance parameters of the precipitator and the dynamic factors of both corona and arc discharge, results in a range of dynamic values for the various excitations/response parameters. For the sake of simplicity, the pulse-like conductions are considered to be near-sinusoids superimposed on top of much higher quiescent conduction values, and they produce an overall ripple-like waveform. Under these circuit conditions, any value of average applied voltage (some specific point on the KVavg curve shown, for example, point A), would result in some average resulting current through the precipitator (the corresponding current value on the horizontal axis shown as point B), having the usual peak-to-peak voltage values shown as points C and D superimposed thereon. This situation produces three voltage values directly associated with a particular current value as shown in FIG. 1, and the curves 14, 16 and 18 represent these three voltage values for a range of operating current values. Alternatively, for ease of visualization, one could consider the KVmin and KVpeak curves as representing the envelopes of a ripple voltage superimposed on KVavg wherein the ripple is largely reflective of the load characteristics, as compared to the more usual source-induced ripple.

The presence of the localized maximum region 20 in the KVmin curve 18 serves as the key factor in the control method of the present invention, but is not in convenient form to be used by the apparatus to be disclosed as an illustrative embodiment. This is due simply to the system polarities involved, and is readily overcome by an additive offset voltage technique which transforms the curves of FIG. 1 into those of FIG. 2.

Figure 2:
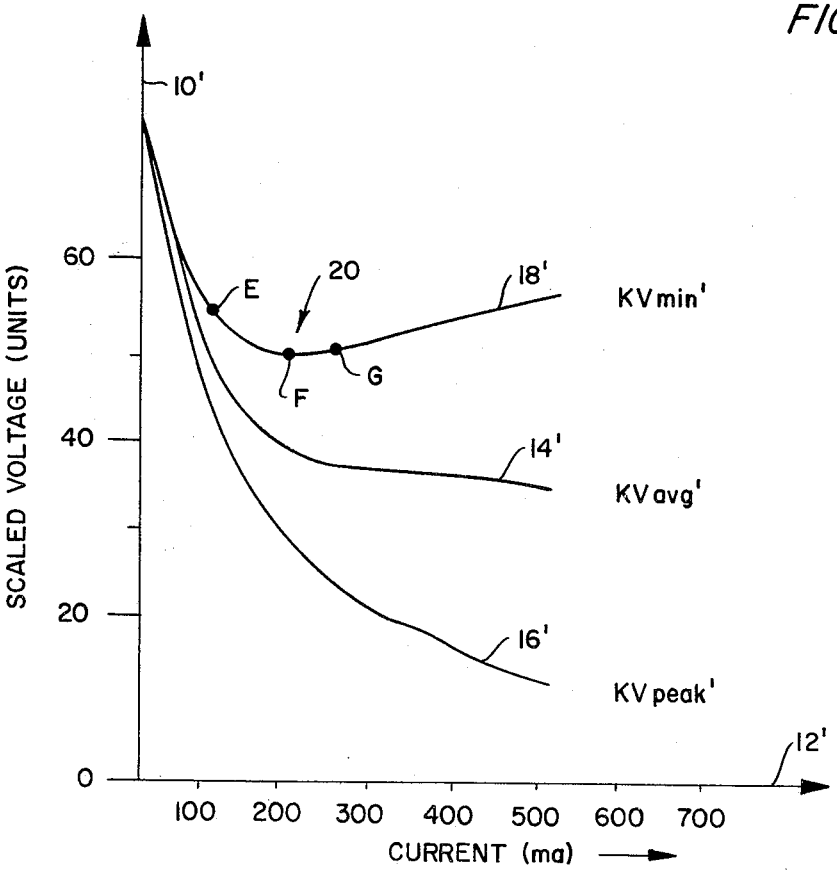
FIG. 2 is a scaled down replica of the curves of FIG. 1 showing the effects of adding an offset voltage.

Referring now to FIG. 2, we note that the same data are presented in a "first quadrant" coordinate system, as compared to the "fourth quadrant" coordinate system of FIG. 1. The modified vertical axis 10' again represents a modified form of kilivolts in magnitude, but reflects an upward bias of the range of electrode voltages offset by a sufficient amount (about +50 KV) to assure that the curves of FIG. 1 will all be positive when plotted in FIG. 2. Also, note that the KVmin' curve 18' now represents the most positive excursion of the "peak-to-peak ripple" around the KVavg' curve 14'. Therefore, a simple peak detector circuit can readily provide the contours of KVmin' curve 18' to a control circuit, which could then readily control an electrostatic precipitator system to operate anywhere desired in the localized maximum region 20. The prime notation is used to denote the fact that the values shown in FIG. 2 correspond to, but not equal in absolute value to those shown in FIG. 1.

Figure 3:
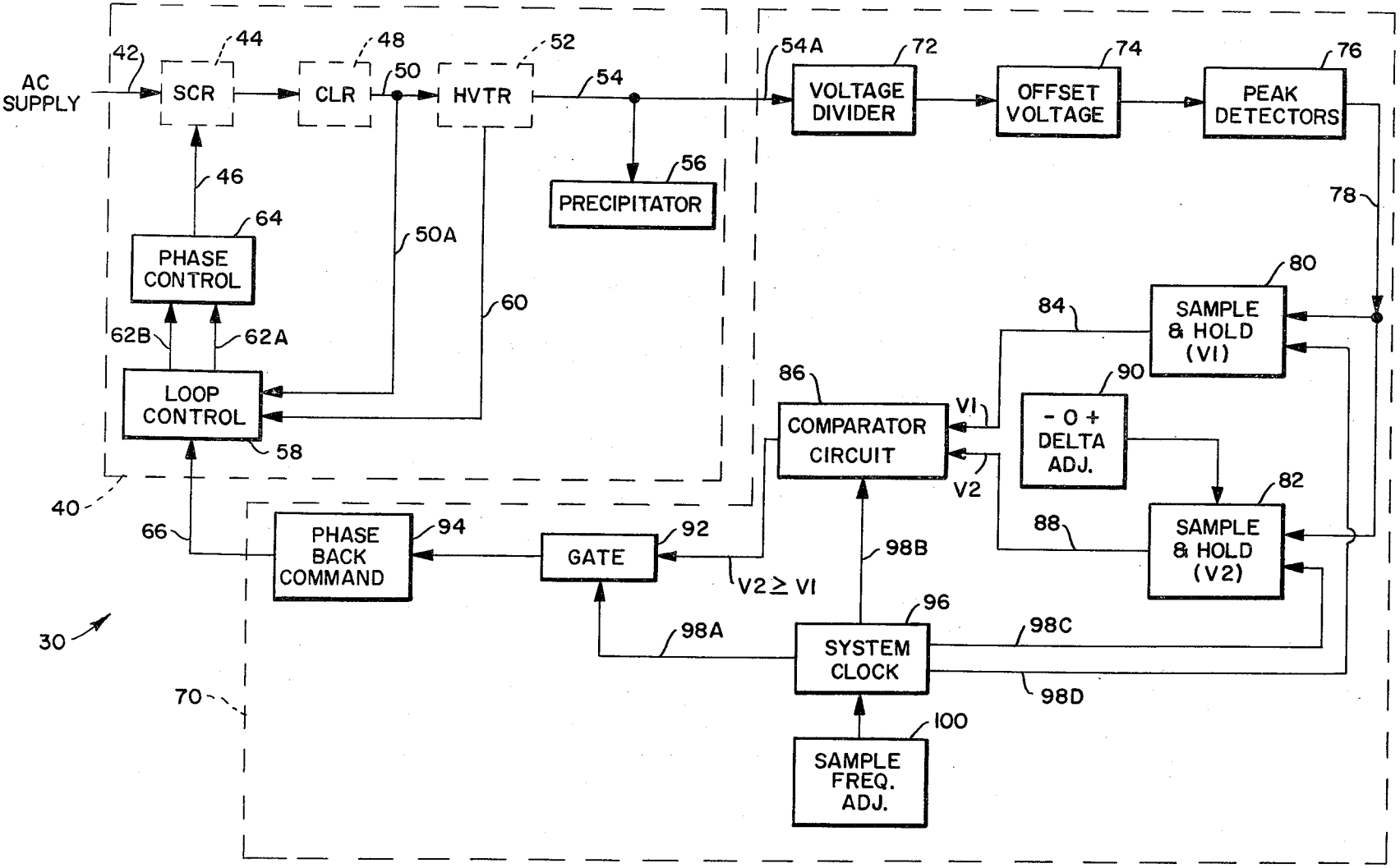
FIG. 3 is an overall block diagram of a control system used to implement the automatic electrostatic precipitator optimizing action according to the present invention.

Referring now to FIG. 3, there is shown a detailed blocked diagram of an electronic control system used to implement the automatic optimizing action of an electrostatic precipitator operating according to the present invention.

The overall control system 30 is comprised of two major components designated as a primary electrostatic precipitator control system 40, and an automatic high resistivity electrostatic precipitator control system 70. The primary system 40 includes well known circuitry used to apply predetermined high voltage excitation to the precipitator chamber field, and includes automatic closed loop features to assure precision and long term stability of the controlled process. A detailed description of a control method and apparatus which might illustratively serve as the primary system 40 is contained in the aforementioned U.S. Pat. No. 3,507,096 to Hall and Jakoplic. Briefly, the primary system 40 receives a source of A.C. power via a path 42 and applies it to an SCR control circuit 44 comprised of a pair of back-toback SCR's which are selectively gated on via phase control signals via a path 46. The SCR-gated A.C. power is thereafter routed serially through a current limiting reactance (CLR) 48, and via a path 50 to the primary of a high voltage transformer contained within the high voltage transformer and rectifier circuit (HVTR) 52. A full wave bridge rectifier also located within the HVTR 52, and operating in the tens of kilovolt range, delivers the rectified unfiltered high voltage excitation via a path 54 to the individual precipitator electrodes of the chamber field located within a precipitator 56. The high voltage excitation is further routed via a path 54A as a sample input to the automatic system 70. A load current signal is sampled in the path 50 and is fed back via a path 50A to a first input of a loop control circuit 58. An excitation voltage signal is sampled in the HVTR 52 and is fed back via a path 60 to a second input of the loop control circuit 58, whose output is routed via paths 62A and 62B to a pair of inputs of a phase control circuit 64. A third signal to the loop control circuit 58 is applied via a path 66 from an output of the automatic system 70.

In summary, the primary system 40 provides automatically phased control of an input A.C. power source and converts the controlled excitation into suitable voltage levels for closed loop operation of the electrostatic precipitator 56. While the primary system 60 can function as a stand alone electrostatic precipitator control loop as disclosed in the aforementioned Hall et al Patent, greatly improved electrostatic precipitator performance is obtained when the primary system 40 is coupled as shown for operation in combination with the automatic system 70.

Within the automatic system 70, the sampled high voltage excitation from the HVTR 52 on the input path 54A is first routed to a voltage divider 72, and thereafter to an offset voltage circuit 74. The output from the offset circuit 74 (which corresponds to the modified voltage curves of FIG. 2) is routed to a peak detector 76, whose output in turn is routed via a path 78 to first inputs of a pair of identical but independent sample and hold circuits 80 and 82. An output of the sample and hold 80 is routed via a path 84 to a first input of a comparison circuit 86; and an output of the sample and hold circuit 82 is routed via a path 88 to a second input of the comparison circuit 86. A delta adjust circuit 90 provides a second input, a selectable offset voltage, to the sample and hold circuit 82. An output of the comparison circuit 86 is routed to a first input of a gating circuit 92 and thereafter to a phase back command circuit 94. A system clock 96 provides a plurality of outputs on paths 98A–98C as follows: An output on path 98A is routed to the gating circuit 92; an output on path 98B is routed as a third input to the comparison circuit 86; and a pair of outputs are routed via paths 98C and 98D as second inputs respectively to the sample and hold circuits 82 and 80. A sample frequency adjust circuit 100 provides a variable control signal to the system clock 96.

Functionally, the automatic system 70 serves to optimize the overall system 30 by monitoring the performance of the primary system 40, as it is represented by the voltage/current curves of FIG. 2, and by automatically establishing and maintaining precipitator operation in the desired region 20 of KVmin' curve 18'.

The voltage divider 72 serves to reduce the sampled high voltage excitation voltage to convenient levels—say, some 30 dB(1000 to 1), or 40 dB(10,000 to 1) thereby reducing the approximately 30 to 50 KV excitation level voltages to levels compatible with conventional solid state processing circuitry. This is accomplished without materially effecting the shape of the potentials such that the reduced voltage levels at the output of the voltage divider 72 are faithful replicas of the instantaneous potentials within the chamber field. An appropriate offset voltage is inserted by the offset circuit 74 thereby conditioning the instantaneous voltages for processing in the peak detector 76. Thus, this scaled down and offset "replica" of the instantaneous voltages present within the precipitator are those represented in FIG. 2, and so are shown in arbitrary "units" on the 10' axis. The input of the peak detector 76 is substantially the envelope of the KVmin' waveform shown in FIG. 2, both as to polarity and general configuration. The output of the peak detector 76 is a steady DC voltage representative of the operating point of the overall control system 30, and particularly reflective of the instantaneous KVmin' value within the system, for the particular set of operating conditions extant. Referring briefly to FIG. 2, if the overall system 30 is operating under conditions where the average precipitator current is approximately 270 ma, and this is producing a scaled KVavg' value of approximately 38 units at the input of the peak detector 76, then the peak detector 76 would be providing an output voltage of approximately 51 units due to the peak detection of the scaled KVmin' waveform at the point G as shown. For various operating points which may be established for the overall system 30, the output of the peak detector 76 might take on from time to time the discreet values corresponding to the points E or F on the scaled KVmin' curved 18', or may take on the full range of values represented by the KVmin' curve 18'.

Figure 4:
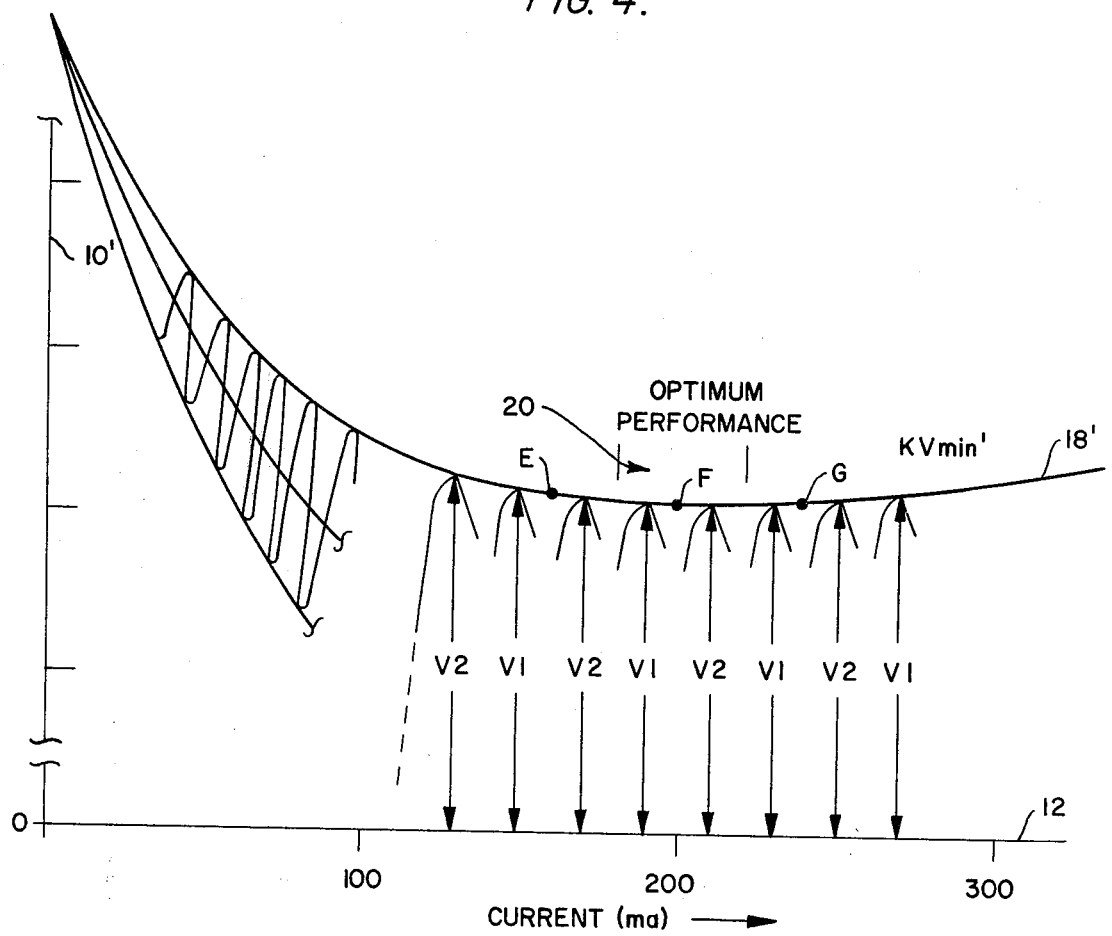
FIG. 4 is an expanded version of FIG. 2 showing the successive samples of the KVmin curve in the vicinity of the optimum operating region.

The sample and hold circuits 80 and 82 are directed by the system clock 96 to briefly sample the output of the peak detector 76 at predetermined intervals, and to provide the sensed and held values to the comparison circuit 86. Brief reference to FIG. 4 shows the interleaving action of the sample and hold process ordered by the system clock 96 via the lines 98C and 98D. The sample and hold circuit 80 is first actuated producing a sample voltage V1, and the sample hold circuit 82 is subsequently actuated producing a sample voltage V2. The process is periodic as shown in FIG. 4 and produces the cyclical values of V1, V2, and so forth, as shown therein by the magnitude and separation of the arrows associated with each sample. The successive values of V1 produced appear on the line 84, and those of V2 appear on the line 88 as shown in FIG. 3. A properly phased output from the system clock 96 via the line 98B initiates a repetetive comparison of the two values and the results of this comparison are provided as follows: If the value of V2 is greater than or equal to V1, the comparison circuit 86 provides an assertion output level. If the value of V2 is less than V1, a quiescent level (i.e., no output) is produced by the comparison circuit 86. The output level from the comparison circuit 86 is logically gated by an enabling output from the system clock 96 and is applied as a periodically updated decision level to the phase back command circuit 94. The output of the phase back command circuit 94 is routed into the control loop of the primary system 40 via the path 66 and serves to provide an additive and dynamic order into that system. Thus, the phase back circuit 94 is ordered to take action when V2 is greater than V1, and is quiescent otherwise, thereby implementing the overall control system 30 action as follows.

Consider first that the primary system 40 operates substantially as described in the aforementioned Hall et al Patent, but is reconfigured slightly so as to include a selectable mode wherein a small positive operating bias is inserted into the output of loop control 58. This is done so as to cause the firing angle of the phase control circuit 64 to increase slowly in time. Thus, the overall control system 30 would tend, in the absence of an output from the automatic system 70, to begin operation at some preset current, or voltage level, and slowly increase hereafter. This would give rise to a slowly sweeping operating action as depicted generally in FIG. 4. That is, system operation would tend to move in time from point E on the KVmin' curve 18' to point F, and subsequently to point G. With continued reference to both FIGS. 3 and 4, it is seen that the successive values of V1 and V2 shown produce different control system orders due to the compared values of V1 and V2. In the vicinity of the point E, it is seen that V1 is greater than V2 so that the output on the comparison circuit 86 and therefore the output of the phase back circuit 94 are quiescent. The system will continue under the influence of the positive bias and would tend to operate in the vicinity of point F or G. For both of these later conditions, the comparison circuit 86 would produce an assertion output level corresponding to the condition V2 greater than or equal to V1, which level would then actuate the phase back control circuit 94. The phase back control circuit 94 thereupon introduces an appropriate signal into the loop control 58 to overcome the effects of the positive bias, and causes the system to remain within the region 20. More specifically, the system would continue with its slow positive bias/phase back action, but would always favor an operating region closer to point E than point G. This is due simply to the "equal to" portion of the "V2 greater than or equal V1" decision, and leads to operation at the lowest system power levels, as is apparent with reference to horizontal current axis 12 of FIG. 4. For example, overall system 30 operation near the point E shows the precipitator current to be (illustratively) 150 ma, while operation near the point G shows the precipitator current to be about 270 ma.—a significant difference!. This clearly more efficient operation is achieved even under precipitator operating conditions wherein the resistivity of the ash being processed produces voltage/current curves for KVmin which tend to have a broad flat plateau in the region 20, or even for curves which are not purely monotonic.

To further enhance the usefulness of the present optimizing method, a delta adjust feature has been included. The delta adjust circuit 90 provides an output to the sample and hold circuit 82 which causes the V2 sample to be shifted in amplitude to range from greater or lesser amplitude than its actual value. Thus, the system calibration can be fine tuned via a vernier of V2 amplitude bias which will allow controlling to the right or to the left of the optimum performance area. This feature results in the overall control system 30 being suitable for a wide range of conditions determined by, for example, the type of coal being fired, and is useful because it has been observed that optimum energization does not always occur exactly where the KVmin inflection point occurs. Under some operating conditions, operation at a KVmin level closer to the E or G regions (of FIG. 4) is preferred, and the V2 amplitude biasing capability of this delta adjust circuit enables this vernier action.

In order to provide a clear and unencumbered teaching of the unique method of the present invention, a number of functional details has been referred to only briefly. For example, it is clearly necessary that the various sampling rates and phasing signals of the system clock 96 be quantified with due regard to the operating conditions of the physical plant under control; and also that the positive bias/phase back action be implemented with due regard to the usual stability and transient criteria of the closed loop control art. These considerations are believed to be well known to those routiners in the respective electrostatic precipitation operation arts, and control system arts. Thus, the sample frequency adjust 100 may be used to provide a vernier adjustment between the V1 and V2 sampling rate, and may be further be set to provide operation wherein the V1 and V2 samples are taken as close as practical to the actual temporal peaks within the KVmin curves so as to provide a more precisely timed control system. Additionally, the circuitry details for the elements designated 70 to 100 have been de-emphasized in order to best convey the type of embodiment contemplated. As before, the circuit detials are well within the province of the routineer, and most of the components of the illustrative embodiment are commercially available items. For example, the sample and hold functions could be accomplished by conventional digital peak reading voltmeters; the comparison function could be performed by a TI SN 5485 magnitude comparator chip; and a TI type 54LS124 chip could serve as the controllable system clock.

Although the present invention has been described in terms of a preferred embodiment and an illustrative apparatus, the invention should not be deemed limited thereto since other embodiments and modifications will readily occur to one skilled in the art. For instance, conversion of the instantaneous values depicted in FIG. 1 to those of FIG. 2 has been accomplished by the expedient of a voltage divider and an additive offset voltage circuit. Any number of other ways could readily be used to accomplish this voltage scale down and axis shift, including techniques such as AC coupling, transformer coupling, and so forth. Also, the sweeping/-phase back action of the illustrative embodiment could readily be tightened (in the servomechanism sense) so as to function more closely as a conventional linear closed loop control system wherein the sweeping action is reduced, or even eliminated. It is therefore to be understood that the appended claims are intended to cover all such modifications as fall within the true spirit and scope of the invention.

We claim:

1. A control circuit for an electrostatic precipitator comprising:

(a) primary control means for applying and adjusting electrode input power to said precipitator in response to at least one sensed and fed back operating parameter of said precipitator;

(b) voltage conditioning means connected to said precipitator for providing a replica of the instantaneous electrode voltages associated with said electrode input power;

(c) a peak detector connected to said voltage conditioning means for detecting the peak magnitude of said replicated instantaneous voltages and for producing an envelope voltage representative thereof;

(d) means for successively taking first and second samples of said envelope voltage and for holding said samples between said successive sample takings;

(e) comparator and feedback means for determining when said second sample is greater than or equal to said first sample and for thereupon applying an electrode input power feedback signal to said primary control means to thereby adjust said input power.

2. The control circuit of claim 1 wherein said primary control means comprises duty cycle modulated solid state switching means to provide said input power adjusting, and said feedback signal in part controls said duty cycle.

3. The control circuit of claim 2 wherein said solid state switching means comprises at least one silicon controlled rectifier and said duty cycle modulation is trigger phase modulation.

4. The control circuit of claim 1 wherein said voltage conditioning means comprises a voltage divider and an offset voltage to scale down and modify the DC level of said instantaneous electrode voltages.

5. The control circuit of claim 1 wherein said means for successive sample taking comprises means for taking said first and second samples at regularly recurring intervals and further for introducing an adjustable increase or decrease voltage to the second sample.

6. An automatic control circuit for minimizing the average input power applied to the electrodes of an electrostatic precipitator having a minimum region in a particular instantaneous electrode voltage characteristic corresponding to a desired precipitator operating condition comprising:

(a) primary control means for applying and adjusting electrode input power to said precipitator responsive to a control signal;

(b) voltage conditioning means for providing a replica of the instantaneous electrode voltages resulting from said applied input power;

(c) a peak detector connected to said voltage conditioning means for detecting the peak magnitude of said particular instantaneous electrode voltage characteristic and for producing an envelope voltage representative thereof;

(d) means for successively taking first and second samples of said envelope voltage and for holding said samples between said successive sample takings;

(e) comparator and feedback means for periodically comparing said first and second held samples and for initiating control signals based on said comparisons for application to said primary control means to maintain the operation of said precipitator in a predetermined portion of said desired operating condition.

7. The automatic control circuit of claim 6 wherein said successive sample taking is substantially synchronous with precipitator operation whereby said detected peak magnitude is a localized maximum in said instantaneous electrode voltages.

8. The automatic control circuit of claim 6 wherein said means for successive sample taking comprises means for taking said first and second samples at regularly recurring intervals and further for introducing an adjustable increase or decrease voltage on the said second sample.

9. The automatic control circuit of claim 6 wherein said particular instantaneous electrode voltage characteristic is the KVmin characteristic.

10. The automatic control circuit of claim 6 wherein said primary control means comprises phase gated silicon controlled rectifiers and said means for successive sample taking comprises means for taking said first and second samples at adjustable but regularly recurring intervals, and further for introducing an adjustable increase or decrease of the voltage level of the second sample.

11. A method of controlling the input power applied to the electrodes of an electrostatic precipitator comprising:

(a) periodically sensing a first peak magnitude of a particular instantaneous electrode voltage characteristic;

(b) causing the precipitator to effect a small change in its operating conditions;

(c) periodically sensing a second peak magnitude of said particular characteristic; wherein said first sensed magnitude precedes and said second sensed magnitude follows said small change in said operating conditions; and (d) initiating control signals based on a comparison of the relative magnitudes of said first and second peak magnitudes for controlling the input power of said precipitator.

12. The method of claim 11 wherein the method of controlling comprises the step of minimizing the average input power applied to said precipitator and said caused small change is made in the average operating conditions of said precipitator.

13. The method of claim 12 wherein the said precipitator exhibits an inflection region in said particular instantaneous electrode voltage characteristic.

14. The method of claim 13 wherein said particular instantaneous electrode voltage characteristic is the KVmin characteristic.

15. The method of claim 15 wherein periodic sensing of said first and second magnitudes is substantially synchronous with precipitator operation whereby said peak magnitudes are localized maxima in said particular instantaneous electrode voltages.

* * * * *